US010550643B2

(12) United States Patent
Ren et al.

(10) Patent No.: US 10,550,643 B2
(45) Date of Patent: Feb. 4, 2020

(54) STEERING SYSTEM AND METHOD

(71) Applicant: Baker Hughes Oilfield Operations LLC, Houston, TX (US)

(72) Inventors: Zhiguo Ren, Shanghai (CN); Xu Fu, Shanghai (CN)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 82 days.

(21) Appl. No.: 15/524,790

(22) PCT Filed: Nov. 6, 2015

(86) PCT No.: PCT/CN2015/093983
§ 371 (c)(1),
(2) Date: May 5, 2017

(87) PCT Pub. No.: WO2016/070841
PCT Pub. Date: May 12, 2016

(65) Prior Publication Data

US 2017/0350191 A1 Dec. 7, 2017

(30) Foreign Application Priority Data

Nov. 6, 2014 (CN) ..... 2014 1 0620893

(51) Int. Cl.
*E21B 7/06* (2006.01)
*E21B 7/04* (2006.01)

(52) U.S. Cl.
CPC ..... *E21B 7/062* (2013.01); *E21B 7/06* (2013.01); *E21B 7/04* (2013.01)

(58) Field of Classification Search
CPC ..... E21B 7/062; E21B 7/06; E21B 7/04
See application file for complete search history.

(56) References Cited

U.S. PATENT DOCUMENTS

| | | | |
|---|---|---|---|
| 3,129,776 | A | 4/1964 | Mann |
| 4,185,704 | A | 1/1980 | Nixon, Jr. |
| 5,685,379 | A | 11/1997 | Barr et al. |
| 5,706,905 | A | 1/1998 | Barr |
| 6,089,332 | A | 7/2000 | Barr et al. |

(Continued)

FOREIGN PATENT DOCUMENTS

| | | | |
|---|---|---|---|
| CA | 2 834 863 | A1 | 11/2012 |
| CN | 1192796 | A | 9/1998 |

(Continued)

OTHER PUBLICATIONS

Downton, G. C., "Challenges of Modeling Drilling Systems for the Purposes of Automation and Control," Copyright held by the International Federation of Automatic Control, pp. 201-210 (May 31-Jun. 1, 2012).

(Continued)

*Primary Examiner* — Brad Harcourt
(74) *Attorney, Agent, or Firm* — Cantor Colburn LLP

(57) ABSTRACT

A system for steering a drilling device comprising a drill pipe, is provided therein, the system comprising: a hoop sleeved on the drill pipe of the drilling device and having an outer diameter substantially equal to an inner diameter of a hole to be drilled; and a steering driving mechanism provided between the hoop and the drill pipe, for controlling a radial displacement of the drill pipe relative to a center axis of the hole to be drilled while drilling. The steering driving mechanism comprises one or more sub-mechanisms for connecting the hoop and the drill pipe and driving the drill pipe to move inside the hole, wherein each of the sub-mechanisms comprises an actuator adjustable in length, and a link element with one end rotatably coupled to the actuator and the other end rotatably coupled to hoop.

10 Claims, 6 Drawing Sheets

(56) References Cited

U.S. PATENT DOCUMENTS

| | | | | |
|---|---|---|---|---|
| 7,136,795 | B2 | 11/2006 | Downton | |
| 7,147,066 | B2 | 12/2006 | Chen et al. | |
| 7,810,585 | B2 | 10/2010 | Downton | |
| 7,926,592 | B2 | 4/2011 | Smith et al. | |
| 8,104,548 | B2 | 1/2012 | Ma et al. | |
| 8,453,765 | B2 | 6/2013 | Haughom | |
| 8,590,636 | B2 | 11/2013 | Menger | |
| 8,827,006 | B2 | 9/2014 | Moriarty | |
| 2002/0185315 | A1* | 12/2002 | McLoughlin | E21B 7/062 175/76 |
| 2007/0144730 | A1 | 6/2007 | Shahin et al. | |
| 2010/0270033 | A1 | 10/2010 | Angelle et al. | |
| 2011/0139513 | A1* | 6/2011 | Downton | E21B 7/067 175/61 |
| 2012/0018225 | A1 | 1/2012 | Peter et al. | |
| 2013/0341098 | A1 | 12/2013 | Perrin et al. | |

FOREIGN PATENT DOCUMENTS

| | | | |
|---|---|---|---|
| CN | 1215789 | A | 5/1999 |
| CN | 101454532 | A | 6/2009 |
| CN | 101772614 | A | 7/2010 |
| CN | 201943580 | U | 8/2011 |
| CN | 202451054 | U | 9/2012 |
| CN | 103334697 | A | 10/2013 |
| CN | 203452689 | U | 2/2014 |
| CN | 104060954 | A | 9/2014 |
| GB | 2 437 645 | B | 9/2009 |

OTHER PUBLICATIONS

Laiju, H., et al., "Development of mechanical tool for automatic vertical drilling," Acta Petrolei Sinica, vol. 29, No. 5, pp. 766-768 (Septemebr, 2008) (Abstract).

Machine translation and International Search Report and Written Opinion issued in connection with corresponding PCT Application No. PCT/CN2015/093983 dated Feb. 22, 2016.

Machine translation and First Office Action and Search issued in connection with corresponding CN Application No. 201410620893.X dated Jun. 5, 2017.

* cited by examiner

STEERING SYSTEM AND METHOD

TECHNICAL FIELD

The present invention relates to a steering system and a corresponding steering method, in particular, to a rotary steerable system and a method for a drilling device comprising a drill pipe.

BACKGROUND TO THE INVENTION

In the exploration for oil and gas well, due to the limitations from factors such as the ground conditions, the subsurface distribution of oil reservoir, etc., it is necessary to change and control the drilling direction and advance the drilling device along a predetermined trace, such that the drilling bit can reach the oil and gas reservoir, where oil and gas may be explored. The wells, such as conventional directional wells, horizontal wells, branch wells, multilateral wells, 3D bypass staggered wells, etc., all need the rotary steering technology.

Recently, with the development of the petroleum and natural gas industry, the demand on oil-gas exploration and production has been increased, thus higher requirements are imposed on the rotary steerable systems.

The traditional rotary steerable systems may be divided into two types: push-the-bit rotary steerable systems and point-the-bit rotary steerable systems. The push-the-bit rotary steerable systems have high build-up rates, but the traces of well bore thereof are not smooth and the well walls are also relatively coarse. The point-the-bit rotary steerable systems are able to form relatively smooth traces of well bore and relatively even well walls, but have low build-up rates.

The movable range of the drill pipe of the existing rotary steerable system is small, and the steering precision is low.

The steering effects of the existing rotary steerable system are much subjected to the conditions of well walls, and an uneven well wall may promote vibrations, further causing a more unsmooth trace of well bore.

Additionally, the existing rotary steerable system has low reliability and short service life, and is vulnerable to impurities like dinas, which may cause the system to operate abnormally, thus the maintenance cost is increased sharply.

Accordingly, there is a need to provide a new rotary steerable system and a method for steering a drilling device, in order to solve the above-mentioned technical problems.

BRIEF DESCRIPTION OF THE INVENTION

In view of the aforementioned technical problems, on the one hand, the present invention provides a system for steering a drilling device comprising a drill pipe, the system comprising: a hoop and a steering driving mechanism. The hoop is sleeved on the drill pipe of the drilling device and has an outer diameter substantially equal to an inner diameter of a hole to be drilled. The steering driving mechanism is provided between the hoop and the drill pipe, for controlling a radial displacement of the drill pipe relative to a center axis of the hole to be drilled while drilling. The steering driving mechanism comprises one or more sub-mechanisms for connecting the hoop and the drill pipe and driving the drill pipe to move inside the hole. Each of the sub-mechanisms comprises an actuator adjustable in length, and a link element rotatably coupled to the actuator at a first end thereof.

On the other hand, the present invention is to provide a drilling method, comprising: first, drilling a hole with a drilling device comprising a drill pipe, wherein a hoop is mounted on the drill pipe of the drilling device, and the hoop has an outer diameter substantially equal to an inner diameter of the hole; second, steering the drilling device while drilling by controlling a radial displacement of the drill pipe relative to an center axis of the hole with a steering driving mechanism between the hoop and the drill pipe. The steering driving mechanism comprises one or more sub-mechanisms, and each of the sub-mechanisms comprises an actuator adjustable in length, and a link element rotatably coupled to the actuator at a first end thereof.

BRIEF DESCRIPTION OF THE DRAWINGS

The present invention can be understood better in light of the following description of exemplary embodiments of the present invention with reference to the accompanying drawings, in which.

DETAILED DESCRIPTION OF THE INVENTION

Figure 1:
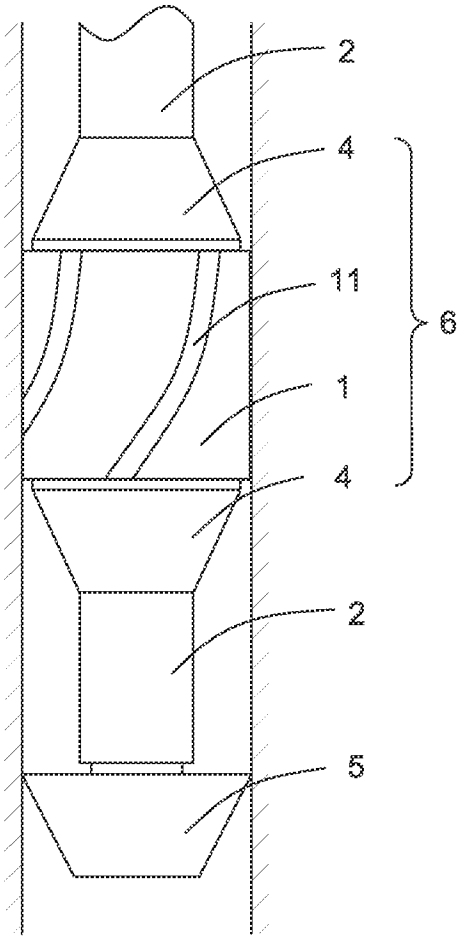
FIG. 1 is a diagram showing the structure of the steering system according to a particular embodiment of the present invention.

Hereinafter, a detailed description will be given for one or more embodiments of the present invention. It should be pointed out that in the detailed description of the embodiments, for simplicity and conciseness, it is impossible for the Description to describe all the features of the practical embodiments in details. It should be understood that in the process of a practical implementation of any embodiment, just as in the process of an engineering project or a designing project, in order to achieve a specific goal of the developer and in order to satisfy some system-related or business-related constraints, a variety of decisions will usually be made, which will also be varied from one embodiment to another. In addition, it can also be understood that although the effort made in such developing process may be complex and time-consuming, some variations such as on design, manufacture and production on the basis of the technical contents disclosed in the disclosure are just customary technical means in the art for those of ordinary skilled in the art relating to the contents disclosed in the present invention, which should not be regarded as insufficient disclosure of the present invention.

Unless defined otherwise, all the technical or scientific terms used in the Claims and the Description should have the same meanings as commonly understood by one of ordinary skilled in the art to which the present invention belongs. The terms "first", "second" and the like in the Description and the Claims do not mean any sequential order, number or importance, but are only used for distinguishing different components. The terms "a", "an" and the like do not denote a limitation of quantity, but denote the existence of at least one. The terms "comprises", "comprising", "includes", "including" and the like mean that the element or object in front of the "comprises", "comprising", "includes" and "including" cover the elements or objects and their equivalents illustrated following the "comprises", "comprising", "includes" and "including", but do not exclude other elements or objects. The term "coupled" or "connected" or the like is not limited to being connected physically or mechanically, but may be connected electrically, directly or indirectly. Additionally, "a circuit", or "a circuit system", or "a controller" or the like may include a single assembly, or a set of active elements and passive elements directly or indirectly connected together, such as one or more integrated circuit chips, for providing the corresponding functions as described.

The terms "may", "might", "can" and "could" in the present application indicate the possibility of occurrence in case of some environments, have a certain property, feature or function; and/or by combining with a qualified verb, indicate one or more capacities, functions or likelihood. Correspondingly, the use of "may" indicates that the modified terms are apparently appropriate, matchable or suitable; at the same time, in view of the presence of some situations, the modified term may be not appropriate, matchable or suitable. For example, in some cases, a result or performance may be expected to appear; while in other cases, it may not appear. This difference is embodied in the terms signifying "may".

With reference to FIG. 1, the steering system provided by the present invention is adaptable for general drilling devices. Typically, a drilling device comprises a drill pipe 2 and a drilling bit 5 fixedly provided at the tip of the drill pipe 2. During drilling, the drilling bit 5 rotates with the drill pipe 2, rotarily cutting a target object, so as to form a cylindrical hole in the target object.

Figure 4:
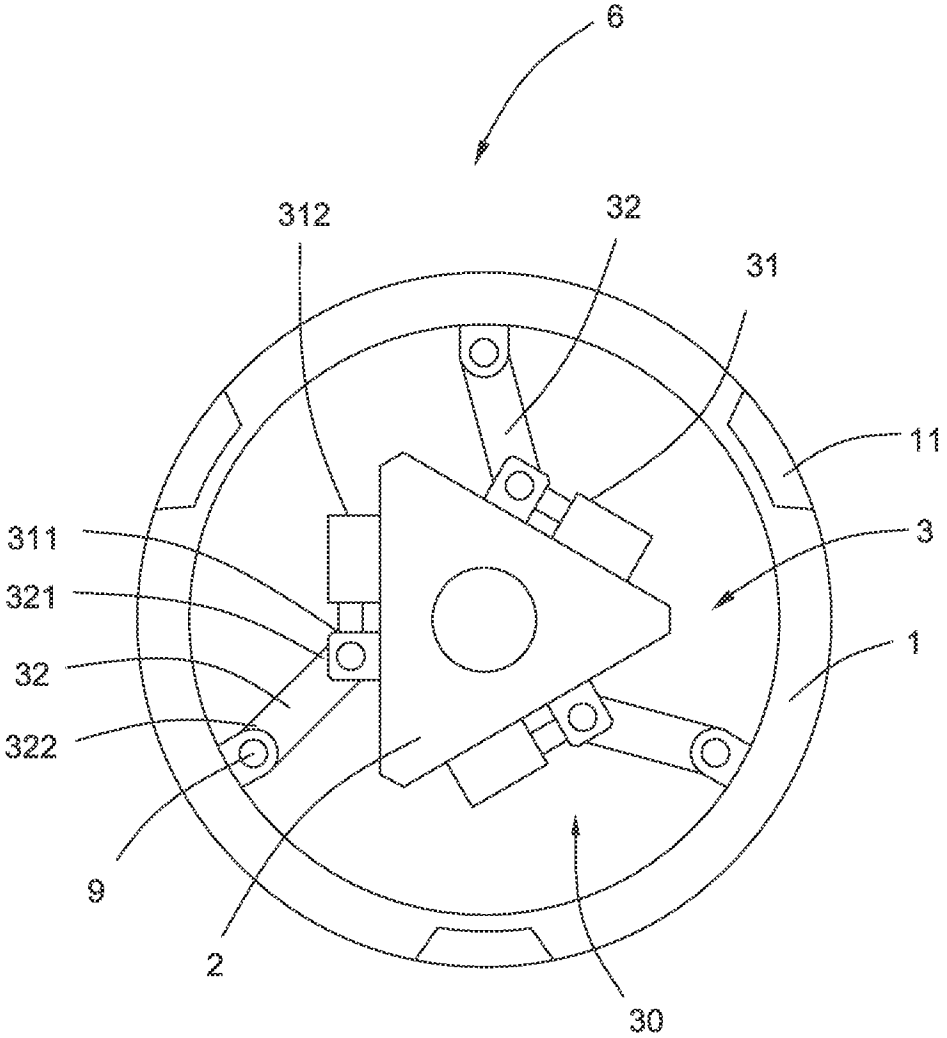
FIG. 4 is a sectional view of the steering system shown in FIG. 1.

With reference to FIGS. 1 and 4, the rotary steerable system 6 provided by the present invention comprises a hoop 1 and a steering driving mechanism 3. The hoop 1 is sleeved on the drill pipe 2 of the drilling device and has an outer diameter substantially equal to an inner diameter of a hole to be drilled. The steering driving mechanism 3 is provided between the hoop 1 and the drill pipe 2, for controlling a radial displacement of the drill pipe 2 relative to a center axis of the hole while drilling. The drilling bit 5 may be steered by controlling the direction of the radial displacement. The offset degree of the drilling bit 5 may be controlled by controlling the magnitude of the radial displacement, so as to obtain the desired build-up rate. By combining these two operations, the desired trace of well bore may be finally acquired.

With reference to FIG. 1, the outer diameter of the hoop 1 is substantially equal to the inner diameter of the hole to be drilled, and the central axis of the hoop 1 is substantially equal to the central axis of the hole to be drilled. As such, the moving direction of the hoop 1 is limited, and the hoop 1 may be able to slide only along the axial direction of the hole, and unable to have a relative movement to the hole in the radial direction, thus when the steering driving mechanism 3 drives the drill pipe 2 to move in a radial direction relative to the hoop 1, the drill pipe 2 also moves in a radial direction relative to the hole.

Figure 2:
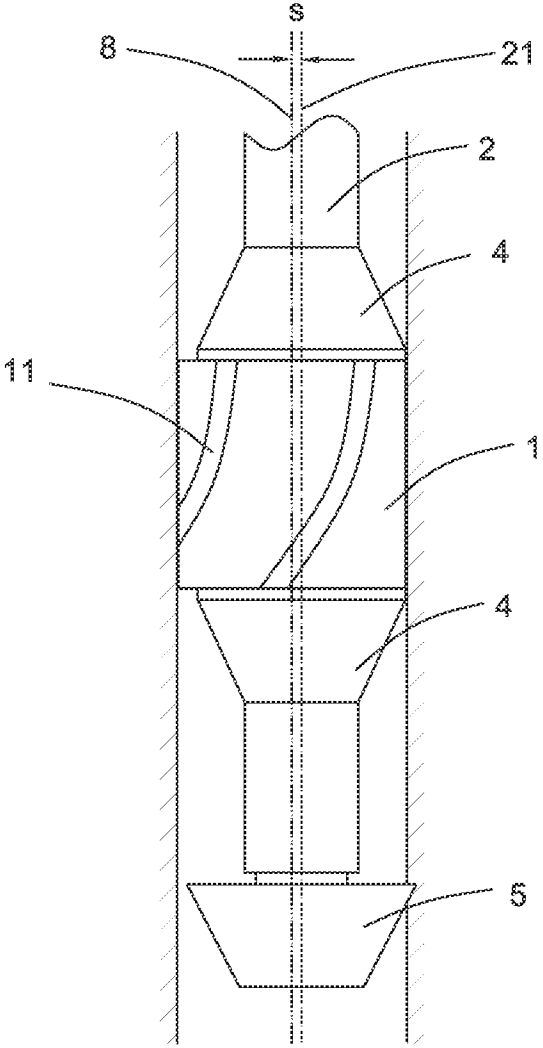
FIG. 2 is a diagram of the steering system shown in FIG. 1 in a steering status.

FIG. 2 is a diagram of the rotary steerable system in a steering status, in which, the central axis 21 of the drill pipe 2 is offset from the central axis 8 of the hole, that is, the drill pipe 2 is deflected by a radial displacement S relative to the central axis 8 of the hole. At this time, the drilling bit 5 fixed to the tip of the drill pipe 2 is also offset from the central axis 8, deflected to one side 7 of the wall of the hole. Then, the travel direction of the drilling bit 5 also changes toward the side 7 along the offset direction. The greater the radial displacement S is, the greater the build-up rate will be.

In some embodiments, the rotary steerable system 6 is a closed-loop control system, and based on a present radial displacement and a given value, the steering driving mechanism 3 is able to adjust the radial displacement S to the given value. Preferably the steering driving mechanism 3 adjusts the radial displacement S based on the difference between the current radial displacement and the given value, wherein the given value is determined by the desired build-up rate.

With reference to FIG. 4, the steering driving mechanism 3 comprises one or more sub-mechanisms 30 between the hoop 1 and the drill pipe 2, for connecting the hoop 1 and the drill pipe 2. In some embodiments, the hoop 1 may be able to rotate with the drill pipe 2 around the central axis, but unable to slide axially relative to the drill pipe 2.

The sub-mechanisms 30 further drive the drill pipe 2 to move inside the hoop 1. With reference to FIG. 4, each of the sub-mechanisms 30 comprises an actuator 31 and a link element 32. The actuator 31 is adjustable in length, and the link element 32 is rotatably coupled to the actuator 31 at a first end 311 thereof.

In some embodiments, the second end 322 of the link element 32 is connected to the inner wall of the hoop 1, and the second end 312 of the actuator 31 is connected to the drill pipe 2. Furthermore, as shown in FIG. 4, the second end 322 of the link element 32 is rotatably connected to the inner wall of the hoop 1 by a hinge 9, and a part of the actuator 31 is fixedly connected to the drill pipe 2.

Additionally, the position relationship between the actuator 31 and a link element 32 is not limited to that indicated in FIG. 4, and in some other embodiments, the second end 322 of the link element 32 may be connected to the drill pipe 2, and the second end 312 of the actuator 31 may be connected to the inner wall of the hoop 1.

In this embodiment, on basis of the actuator 31, the link element 32 is added for performing a combined control on the drill pipe 32, and both ends of the link element 32 are connected rotatably, such as, pivoted by the hinge 9, which increases the radial movable range of the drill pipe 2 in the hoop 1, thereby improving the precision of the steering driving mechanism 3 controlling the drill pipe 2.

The drill pipe 2 is not limited to be cylindrical, and in some embodiments, the outer surface of the wall of the drill pipe 2 may have a cross section of a triangle shape, as shown in FIG. 4. Each actuator 31 is mounted on one plane such that the actuators 31 are easily designed and mounted, thereby enhancing the stability of the system.

Figure 5:
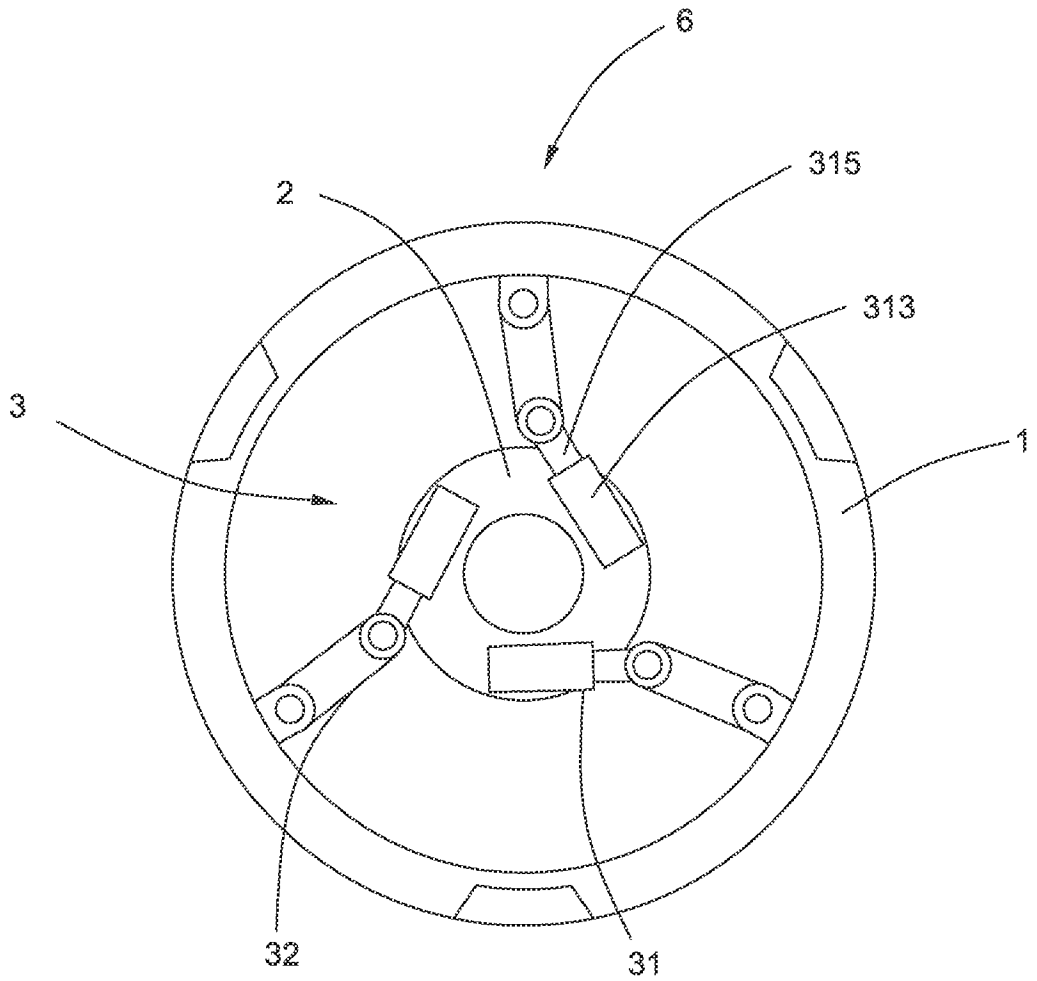
FIG. 5 is sectional view showing the structure of a steering system according to another specific embodiment of the present invention.

With reference to FIG. 5, the actuator 31 may be a hydraulic actuator, including a hydraulic cylinder 313 mounted on the drill pipe 2; and a piston rod 315. The piston rod 315 has one end provided inside the hydraulic cylinder 313, and it may move to-and-fro relative to the hydraulic cylinder 313.

Moreover, as shown in FIG. 5, the hydraulic cylinder 313 is embedded within the wall of the drill pipe 2, and mounted tangent to the drill pipe 2. In such a way, space is substantially saved and the hydraulic cylinder 313 is not vulnerable to impurities, thereby improving greatly the stability of the rotary steerable system.

Figure 3:
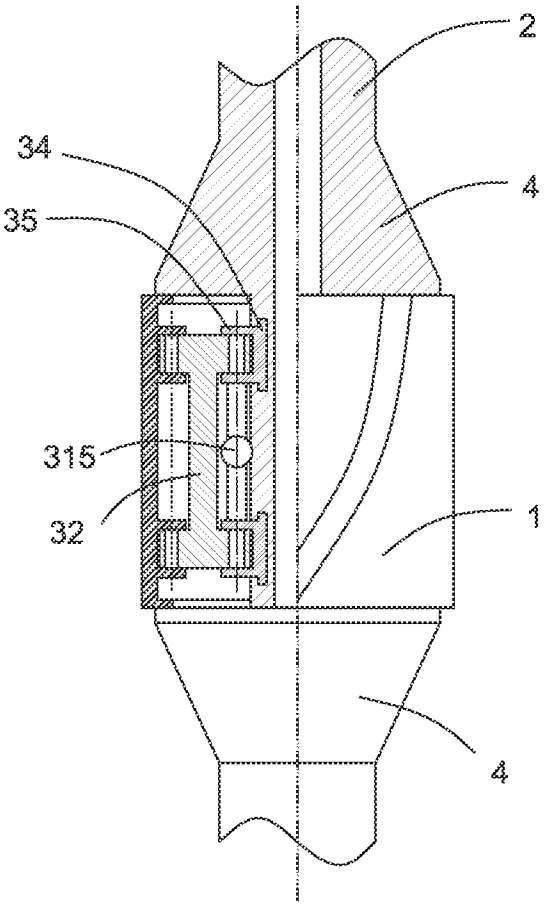
FIG. 3 is a partial cross sectional view of the steering system shown in FIG. 1.
Figure 6:
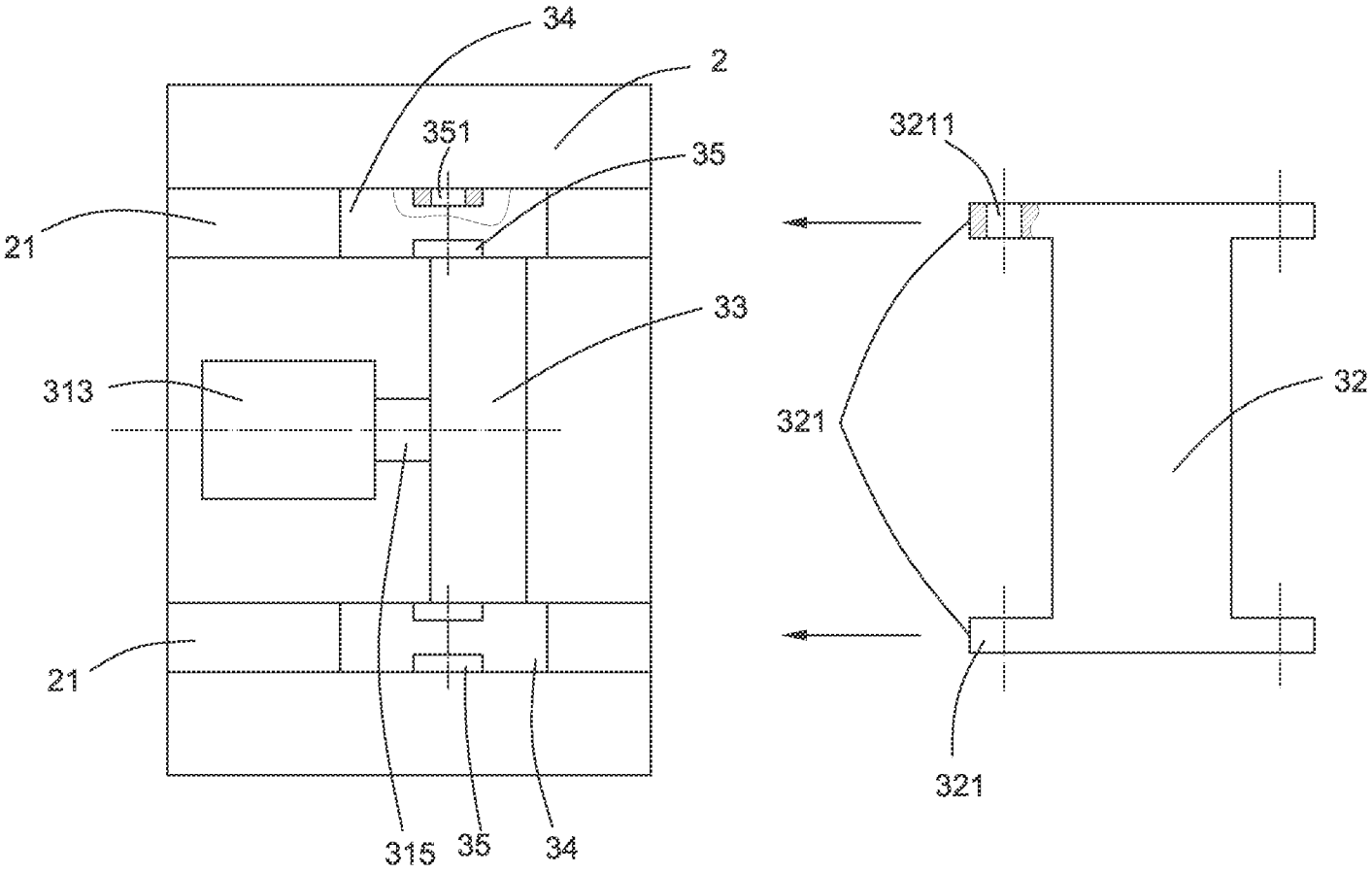
FIG. 6 is an exploded view of an actuator and a link element of the steering system shown in FIG. 1.

With reference to FIGS. 3 and 6, in some embodiments, there are two drill pipe grooves 21 in the outer surface of the drill pipe 2. The actuator 31 further includes a connecting support 33, two blocks 34, and at least two hinge supports 35. The connecting support 33 is coupled to an end portion of the piston rod 315, and perpendicular to the piston rod 315. The two blocks 34 are respectively coupled to two ends of the connecting support 33, provided in the two grooves of the drill pipe 2, and able to slide therein. Each block 34 is fixed with at least one hinge support 35 rotatably coupled to the first end 321 of the link element 32.

In some embodiments, as shown in FIGS. 3 and 6, each block 34 is fixed with two hinge supports 35 so as to enhance the stability of the connection. Each hinge support 35 has a support through-hole 351 thereon, and there is also a linking through-hole 3211 on a first end 321 of the link element 32, the first end 321 being provided between the two hinge supports 35. The central axes of the through-holes 351 and 3211 lie in one line and a pin pass therethrough, such that the first end 321 and the hinge support 35 are connected rotatably. The piston rod 315 drives the first end 321 of the link element 32 to move along the direction of the drill pipe groove 21 by its movement relative to the hydraulic cylinder 313, and simultaneously the link element 32 also rotates around the hinge support 35, so as to further change the relative positions between the drill pipe 2 and the hoop 1.

The steering driving mechanism 3 may include two or more sub-mechanisms 30. For example, in the embodiments as shown in FIGS. 4 and 5, the steering driving mechanism 3 includes three sub-mechanisms 30. The sub-mechanisms 30 are arranged with equal intervals, such that the movable ranges of the drill pipe 2 are distributed evenly, thereby enhancing the stability and reliability of the rotary steerable system 6.

With reference to FIGS. 1 and 4, for preventing impurities such as dinas generated in the drilling process, from entering the hoop 1 to affect the operation of the steering driving mechanism 3 therein, in some embodiments, the rotary steerable system 6 further includes two covers 4. These two covers are used for covering the two axial end faces of the hoop 1 such that the service life of the steering driving mechanism 3 may be prolonged and the stability of the rotary steerable system 6 may be improved.

Further, as shown in FIG. 1, each cover 4 has a ring shape, the outer diameter of which decreases from an end near the hoop 1 to an end distal to the hoop 1, wherein the maximum outer diameter of the cover 4 is smaller than the outer diameter of the hoop 1. Such a design is able to reduce substantially the sliding resistance against the hoop 1 in the hole, and enables it to slide more smoothly therein.

In some embodiments, as shown in FIG. 3, the covers 4 and the wall of the drill pipe 2 are provided integrally, in order to further enhance the design and fabrication, and improve the stability of the system.

In order to enable the mud in the drilling process to pass through the rotary steerable system 6, as shown in FIG. 1, there is at least one hoop groove 11 on the outer surface of the hoop 1 for mud to pass through. The hoop groove 11 may be further designed to be spiral, so as to reduce the resistance against the flowing mud, such that the mud may pass through the hoop 1 more quickly.

Another aspect of the present invention further relates to a drilling method using the rotary steerable system. In some embodiments, the drilling method includes: drilling a hole with a drilling device comprising the drill pipe 2 with a hoop 1 sleeved thereon, wherein the hoop 1 has an outer diameter substantially equal to an inner diameter of the hole; steering the drilling device while drilling by controlling a radial displacement S of the drill pipe 2 relative to an center axis of the hole with a steering driving mechanism 3 between the hoop 1 and the drill pipe 2.

With reference to FIGS. 1, 3, 4, the hoop 1 is cylindrical, has an axial length L, and an outer diameter substantially equal to the inner diameter of the hole. As a result, during drilling, the outer surface of the hoop 1 contacts the inner surface of the hole. In this embodiment, the steering driving mechanism 3 does not directly contact the wall of the hole, but imposes indirectly thereon via the hoop, so as to alleviate the problems such as lagging, vibration caused by the unsmooth wall of the hole, thereby substantially improving the steering effects.

With reference to FIGS. 2 and 5, in some embodiments, the step of controlling the radial displacement S of the drill pipe 2 relative to the central axis of the hole, comprises adjusting the length of each actuator 31, so as to drive the drill pipe 2 to move in a direction different from the drilling direction. The three actuators 31 may be hydraulic actuators, the length of each of which may be adjusted by adjusting the position of the piston rod 315 therein relative to the hydraulic cylinder 313, such that the hydraulic actuators impose commonly on the drill pipe 2, urging it to move to the desired position along a preset trace.

In the drilling process, each of the sub-mechanisms 30 rotates with the drill pipe 2, and the length thereof varies from time to time, such that the drill pipe 2 moves along a preset trace inside the hoop 1, or maintains the relative position between the drill pipe 2 and the hoop 1.

The step of controlling the radial displacement S includes the following: first, receiving a current radial displacement and a given value; second, calculating the difference between the current radial displacement and the given value; then based on the difference, adjusting a radial displacement S by the steering driving mechanism 3, until the radial displacement S becomes equal to the given value.

Although the present invention has been described in conjunction with particular embodiments, the skilled in the art should understand that many modifications and variations may be made. Accordingly, it should be noted that the claims are intended to contain all the modifications and variations within the actual concept and scope of the present invention.

The invention claimed is:

1. A system for steering a drilling device comprising a drill pipe, comprising:

a hoop, sleeved on the drill pipe of the drilling device and having an outer diameter substantially equal to an inner diameter of a hole to be drilled; and a steering driving mechanism, between the hoop and the drill pipe, for controlling a radial displacement of the drill pipe relative to a center axis of the hole to be drilled while drilling, wherein the steering driving mechanism comprises one or more sub-mechanisms for connecting the hoop and the drill pipe and driving the drill pipe to move inside the hole to be drilled, wherein each of the sub-mechanisms comprises an actuator adjustable in length coupled to the drill pipe, and a link element rotatably coupled to the actuator at a first end thereof and coupled to an inner wall of the hoop at a second end.

2. The system according to claim 1, wherein a portion of the actuator is fixedly coupled to the drill pipe, and the link element is rotatably coupled to the hoop at a second end thereof.

3. The system according to claim 1, wherein the actuator comprises a cylinder installed on the drill pipe and a piston rod having one end inside the cylinder and being able to move relative to the cylinder.

4. The system according to claim 3, wherein the drill pipe has two drill pipe grooves on an outer surface thereof; and the actuator further comprises a connecting support, coupled to an end portion of the piston rod, and perpendicular to the piston rod; two blocks, respectively coupled to two ends of the connecting support, provided in the two drill pipe grooves, and being able to slide in the drill pipe grooves; and at least two hinge supports, respectively fixed on the two blocks, the link element being rotatably coupled to the hinge supports at the first end thereof.

5. The system according to claim 1, wherein the hoop has at least one hoop groove on an outer surface thereof for mud to pass through.

6. The system according to claim 1, wherein the steering driving mechanism is able to adjust the radial displacement to a given value based on a current radial displacement and the given value.

7. The system according to claim 1, further comprising two covers for covering two axial end faces of the hoop, respectively.

8. The system according to claim 1, wherein the steering driving mechanism comprises three sub-mechanisms arranged with equal intervals around the drill pipe.

9. A drilling method, comprising:

drilling a hole with a drilling device comprising a drill pipe with a hoop sleeved thereon, wherein the hoop has an outer diameter substantially equal to an inner diameter of the hole; and steering the drilling device while drilling by controlling a radial displacement of the drill pipe relative to an center axis of the hole with a steering driving mechanism between the hoop and the drill pipe, wherein the steering driving mechanism comprises one or more sub-mechanisms, each of which comprises an actuator adjustable in length coupled to the drill pipe, and a link element rotatably coupled to the actuator at a first end thereof and coupled to an inner wall of the hoop at a second end.

10. The drilling method according to claim 9, wherein steering the drilling device comprises adjusting the length of each actuator to drive the drill pipe to move inside the hole along a direction different from a drilling direction.

* * * * *